US006079759A

United States Patent [19]

Payne et al.

[11] Patent Number: 6,079,759

[45] Date of Patent: Jun. 27, 2000

[54] BAG EXTRACTION DEVICE

[75] Inventors: Neil Payne; Glenn Payne, both of Vestal, N.Y.

[73] Assignee: Society of American Independent Inventors, Binghamton, N.Y.

[21] Appl. No.: 09/188,524

[22] Filed: Nov. 9, 1998

[51] Int. Cl.[7] ..... B65D 90/20

[52] U.S. Cl. ..... 294/32; 220/495.04; 220/908; 294/1.1; 294/27.1

[58] Field of Search ..... 294/1.1, 27.1, 294/31.2, 32, 67.1, 67.4, 74, 137, 149, 151, 167, 169; 206/804; 220/495.01, 495.04, 495.06, 668, 745, 908, 908.1; 248/95, 97; 383/6, 121, 13, 33, 100

[56] References Cited

U.S. PATENT DOCUMENTS

| | | | |
|---|---|---|---|
| 445,719 | 2/1891 | Schillinger | 294/27.1 X |
| 1,736,192 | 11/1929 | Easton | 206/804 X |
| 2,127,607 | 8/1938 | Levow | 294/27.1 |
| 3,363,794 | 1/1968 | Dearing | 206/804 X |
| 3,779,156 | 12/1973 | Race . | |
| 4,140,257 | 2/1979 | Peterson | 294/151 |
| 4,294,379 | 10/1981 | Bard | 220/495.04 |
| 5,170,906 | 12/1992 | Kochelek . | |
| 5,375,732 | 12/1994 | Bowers et al. . | |
| 6,015,063 | 1/2000 | Poliquin | 220/495.04 |

*Primary Examiner*—Johnny D. Cherry
*Attorney, Agent, or Firm*—Salzman & Levy

[57] ABSTRACT

A bag extraction device for removing a plastic bag from a bag holding container. The device includes a handle for removing the bag from the container. The handle is attached to a rigid frame that supports the plastic bag. Pores at the bottom of the frame and opening at the top of the frame allow air to flow through its interior. The device substantially equalizes pressure above and below the plastic bag. During extraction from its bag holding container, the bag is prevented from breaking and spilling its contents.

18 Claims, 1 Drawing Sheet

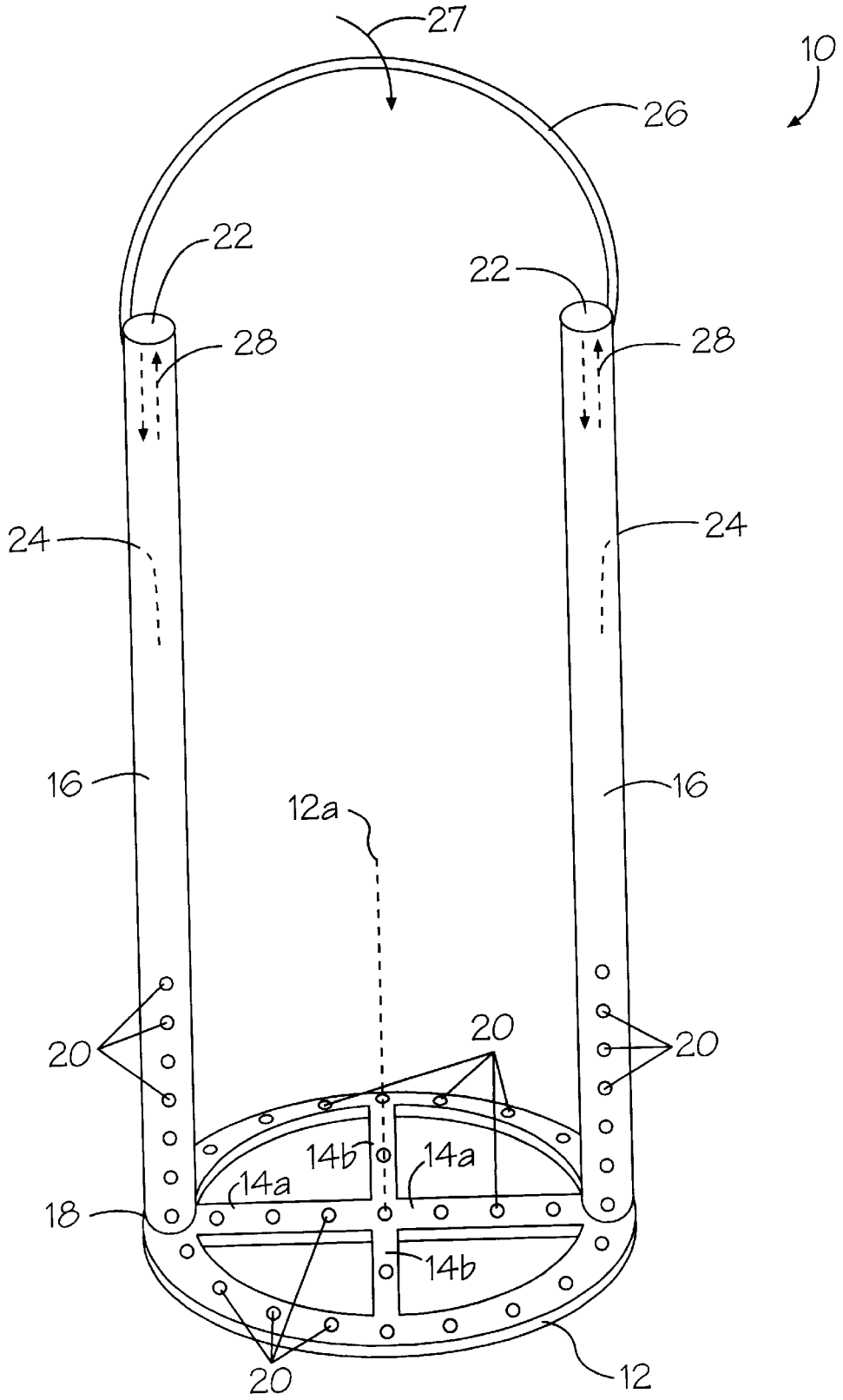
The Figure

BAG EXTRACTION DEVICE

FIELD OF THE INVENTION

The present invention pertains to a device for pulling a plastic bag out of a bag holding container and, more particularly, to a device for overcoming the vacuum created between the bag and the inner surface of the container and minimizing effort to remove the bag from the container.

BACKGROUND OF THE INVENTION

When garbage is placed in a plastic lining bag, disposed in a metal or plastic, rigid garbage pail or other bag holding container, the bag expands until it comes in contact with the inner surface of its bag holding container. The pressure from the garbage in the bag expands against the inner surface of the container. As the pressure increases, air is mostly expunged from between the lower, inner surface of the bag holding container and the bottom portion of the plastic bag. At this point, a partial vacuum is created.

The pressure of the remaining trapped air is less than that of atmospheric pressure on the top of the plastic bag. Therefore, the vacuum is difficult to overcome when trying to remove the plastic bag from the bag holding container.

Pulling harder from above, to remove the plastic bag results in the garbage or other contents settling towards the bottom of the bag, exacerbating the problem of extraction. The combination of pulling on the bag and the weight of the settled garbage can be substantial enough to cause the bag to rupture either at its upper extremities or at its lowermost region(s), spilling the contents thereof.

What is needed is a device to break the vacuum between the lower, inner surface of the bag holding container and the bottom portion of the plastic bag, minimizing the effort needed to remove a plastic bag from its bag holding container.

The present invention provides such a device and is equipped with a handle by which to extract the device, removing the plastic bag from the container. The handle is attached to a framework which mechanically supports the bottom of the bag and prevents it from breaking, upon removing the bag from the container.

Although prior art devices teach vacuum reducing means, the present invention breaks or substantially reduces the vacuum during bag extraction. A handle attached to the framework of the device allows removal of the plastic bag. The combination of a vacuum reducing means and a handle with framework requires an operator to use only minimal effort when removing a plastic bag from a bag holding container.

In U.S. Pat. No. 3,779,156, issued to RACE, a sling is disclosed, comprising handles, specifically designed to conform to the inside of a bin and disposed to underlay a trash bag in the bin. The sling may be withdrawn, thereby removing the trash bag, by exerting a lifting force on its handles.

In U.S. Pat. No. 5,170,906, issued to KOEHELEK, an air channel system for trash containers is shown. The container has an open top, a closed bottom, and an interior surface portion with a plurality of laterally spaced, vertical ribs. Between the ribs are multiple narrow channels that extend longitudinally between the top and bottom of the trash container. The channels provide a means of escape for air trapped between the container and a liner. Similarly, the channels allow air to flow through when a liner is being removed from the bag, thereby preventing a vacuum from forming.

In U.S. Pat. No. 5,375,732, issued to BOWERS et al., a vacuum release garbage can is illustrated. The garbage container comprises an air conduit, which extends along the vertical length of the container, having side wall openings. This design affects the vacuum in the container when a plastic liner is inserted into the garbage can.

SUMMARY OF THE INVENTION

In accordance with the present invention, there is provided a bag extraction device comprising vacuum reducing means and mechanical means for supporting and removing a plastic bag. One particular application of the inventive device is to minimize the effort necessary to remove a plastic bag from a bag holding container.

The present invention equalizes and stabilizes the pressure below the garbage bag so that it is substantially equal to pressure above the bag. This is accomplished by having a framework within a bag holding container, comprising pores and an inner channel, which enables air flow between the air above the bag and the trapped air below the bag. Now, the effort necessary to remove the bag is minimal. To make the job of removing the bag even easier, a handle is provided. The handle is attached to the above-mentioned framework.

It is an object of this invention to stabilize the pressure below a plastic bag so that it is substantially the same as the pressure above the bag.

It is another object of the invention to break the vacuum between the inner surface of the bag holding container and the bottom portion of the plastic bag.

It is another object of the invention to provide a handle by which to remove a plastic bag from a bag holding container.

It is another object of the invention to provide a framework for supporting a plastic bag from below.

It is still another object of the invention to provide a framework for supporting a plastic bag so that the bag does not break when being removed from a garbage holding container.

It is still another object of the invention to have a framework comprising pores and channels through which air can flow.

It is yet another object of the invention to allow air to flow freely through the framework so as to stabilize the pressure below the garbage bag.

BRIEF DESCRIPTION OF THE DRAWINGS

A complete understanding of the present invention may be obtained by reference to the accompanying drawings, when considered in conjunction with the subsequent detailed description, in which the FIGURE is a perspective view of a handle and supporting framework in accordance with the present invention.

DESCRIPTION OF THE PREFERRED EMBODIMENT

Generally speaking, the invention pertains to a waste container extraction device which reduces the vacuum formed between a plastic bag and its bag holding container. The device comprises a handle attached to a frame.

Referring now to the FIGURE, there is shown the bag extraction device 10 of the present invention comprising a base 12 which is planar and approximately circular. However, for square or rectilinear containers, the base 12 need not be circular in shape. Preferably, the base 12 of the extraction device 10 conforms to the inside of the container into which it is placed.

The base 12 further comprises a horizontal cross-member 14*a* and a vertical cross-member 14*b*. The members 14*a* and 14*b* provide additional support at the bottom of a plastic bag, not shown. Members 14*a* and 14*b* also function to make the base 12 rigid, thereby allowing an operator to pull a plastic bag out of a garbage holding container without causing the extraction device 10 to fail (i.e., break). The horizontal cross-member 14*a* and vertical cross-member 14*b* can be made of sections, attached to the base 12 by a method known in the art. It is preferable, however, to have base 12 and cross-members 14*a* and 14*b* in one, integral piece.

An upright member 16 is attached to the base 12 at a connection point 18 by a fastening method such as adhesive, welding, or other method well known in the art. The upright member 16 is operatively connected to the base 12 allowing air flow therebetween. It is desirable to have an extraction device 10 with two upright members 16 substantially opposite one another. This allows a handle 26 to be connected to the two upright members 16, allowing an operator to use only minimal effort to remove a plastic bag.

Now, the function of the horizontal cross-member 14*a* and vertical cross-member 14*b* is clear. When an operator removes the extraction device 10 from a garbage holding container, not shown, an upward force is exerted on the handle 26, thereby causing the upright member 16 to act like a moment arm. The upright member 16 tends to rotate about the connection point 18 towards the center 12*a* of the base 12. Without the support of the both cross-members 14*a* and 14*b*, the base 12 elongates outwardly at connection point 18. If a plastic bag is heavy enough, there will be sufficient tension on the base 12 to cause failure. The horizontal cross-member 14*a* and vertical cross-member 14*b* hold the base 12 together.

The base 12, cross-members 14*a* and 14*b*, and upright member 16 substantially make up the frame 10 of the extraction device 10. This supporting frame 10 is porous and hollow, making the frame 10 lightweight and allowing fluid (air) to flow through its interior. However, the base 12 and its cross-members 14*a* and 14*b* may be solid. Furthermore, the frame 10, as a whole, should be made from a material which is lightweight, cost effective, and able to support the weight of a filled plastic bag. The preferred material for the frame 10 is plastic or a composite thereof.

The base 12 and its cross-members 14*a* and 14*b* have multiple apertures 20 with substantially even amounts of space between them. The apertures 20 extend from the outer surface of the frame 10 to its inner hollow space 24. Preferably, the apertures 20 should also cover a substantial portion of the upright member 16 (i.e., the portion around the bottom of the plastic bag). It is possible, however, that the apertures 20 cover only the lower portion of the upright member 16 and not the base 12 and cross-members 14*a* and 14*b*.

A handle 26 is movably connected to the frame 10 in a fashion well known in the art. More particularly, the handle 26 is attached to the upright member 16. Arrow 27 shows the direction of rotation of the handle 26. The handle 26 is preferably arc-like in shape for strength and to make it less prone to failure. Similar to the frame 10, the handle 26 should be made from a material which is lightweight, cost effective, and able to support the weight of a filled plastic bag and supporting frame 10. The preferred material for the handle 26 is plastic or a composite thereof.

An operator can lift the frame 10 by using the handle 26, minimizing the effort necessary in removing the bag. The supporting frame 10 is placed in a bag holding container with the handle 26 resting atop the periphery of the container. A plastic bag is subsequently placed in the frame 10 and fastened to the bag holding container. Upon removing the plastic bag from the container, the handle 26 is rotated (arrow 27) so that an operator can lift the bag out of the container.

The combined forces of the vacuum and an operator pulling up on a bag is, unfortunately, sufficient to break the bag. The purpose of the frame 10 is to provide support for a garbage bag, preventing it from breaking and spilling its contents. The structure and composition of the supporting frame 10 are important to minimizing the effort needed to remove a bag from a garbage holding container.

There is an opening 22 atop the upright member 16. The opening 22 and the apertures 20 on the base 12, its cross-members 14*a* and 14*b*, and upright member 16 allow air flow (arrow 28) in and out of the space between the lower, inner surface of a bag holding container and the bottom portion of the plastic bag.

The apertures 20 and inner hollow space or air channel 24 are used to equalize and stabilize the pressure below the plastic bag so that it is substantially equal to pressure above the bag. The aperture 20 and air space 24 enable air flow (arrow 28) between the air above the bag and the trapped air below the bag. Air flows (arrow 28) into the apertures 20, through the air space 24, and out an opening 22 at the top of the upright member 16. Conversely, air flows (arrow 28) into the opening 22 at the top of the upright member 16, through the air space 24, and out the apertures 20 of the supporting frame 10. Thus, the pressure below the bag increases while stationary in the bag holding container and upon being pulled out of the container. When the air pressure above and below the bag become substantially the same, it is possible to remove the bag from the container with minimal effort.

Since other modification and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is present in the subsequently appended claims.

What is claimed is:

1. A bag extraction device for removing a bag from a bag holding container, comprising a frame having a substantially planar base and a first upright member attached thereto, said base and said first upright member being substantially hollow and comprising a plurality of apertures for equalizing air pressure inside and outside a bag holding container.

2. The bag extraction device in accordance with claim 1, wherein said frame is rigid.

3. A bag extraction device in accordance with claim 2, wherein said first upright member comprises an opening at the upper portion thereof.

4. The bag extraction device in accordance with claim 1, further comprising a second upright member attached to said base and being spaced apart from said first upright member.

5. The bag extraction device in accordance with claim 4, wherein said first and second upright members have openings at the respective upper portions thereof.

6. The bag extraction device in accordance with claim 5, wherein said second upright member comprises apertures.

7. The bag extraction device in accordance with claim 4, further comprising extraction means movably connected to the upper portion of at least one of said upright members.

8. The bag extraction device in accordance with claim 4, wherein said second upright member is substantially hollow and an air channel is formed among said first and second upright members and said base.

9. A bag extraction device for removing a bag from a bag holding container, comprising a frame having a substantially planar base and a first upright member attached thereto, said first upright member being substantially hollow and comprising a plurality of apertures for equalizing air pressure inside and outside a bag holding container.

10. The bag extraction device in accordance with claim 9, wherein said frame is rigid.

11. A bag extraction device in accordance with claim 10, wherein said first upright member comprises an opening at the upper portion thereof.

12. The bag extraction device in accordance with claim 9, further comprising a second upright member attached to said base and being spaced apart from said first upright member.

13. The bag extraction device in accordance with claim 12, wherein said first and second upright members have openings at the respective upper portions thereof.

14. The bag extraction device in accordance with claim 13, wherein said second upright member comprises apertures.

15. The bag extraction device in accordance with claim 12, further comprising extraction means movably connected to the upper portion of at least one of said upright members.

16. A method of extracting a bag from a bag holding container, the steps comprising:

a) providing a frame having a substantially planar base and a first upright member attached thereto, said base and said first upright member being substantially hollow and comprising a plurality of apertures for equalizing air pressure inside and outside a bag holding container;

b) allowing air flow through said apertures in said frame from below a bag to outside said bag holding container;

c) stabilizing air pressure inside and outside said bag holding container to facilitate extraction of a bag in said bag holding container.

17. The method of extracting a bag from a bag holding container in accordance with claim 16, wherein said first upright member has at least one opening proximate the top thereof.

18. The method of extracting a bag from a bag holding container in accordance with claim 16, wherein the step of stabilizing air pressure substantially equalizes pressure above and below a bag in a bag holding container.

* * * * *